US008007595B2

(12) United States Patent
Hall

(10) Patent No.: US 8,007,595 B2
(45) Date of Patent: Aug. 30, 2011

(54) METHOD FOR IN-SITU CLEANING AND INSPECTING OF A TUBULAR

(75) Inventor: Anthony D. Hall, Halifax (CA)

(73) Assignee: Welaptega Marine Limited, Halifax (CA)

( * ) Notice: Subject to any disclaimer, the term of this patent is extended or adjusted under 35 U.S.C. 154(b) by 758 days.

(21) Appl. No.: 12/039,275

(22) Filed: Feb. 28, 2008

(65) Prior Publication Data

US 2009/0217946 A1 Sep. 3, 2009

(51) Int. Cl.
*B08B 1/02* (2006.01)

(52) U.S. Cl. ..... 134/15; 134/18

(58) Field of Classification Search ..... None
See application file for complete search history.

(56) References Cited

U.S. PATENT DOCUMENTS 4,688,290 A * 8/1987 Hogg ..... 15/104.04
6,119,630 A * 9/2000 Lobsiger et al. ..... 119/238
2005/0174473 A1* 8/2005 Morgan et al. ..... 348/370
2005/0206874 A1* 9/2005 Dougherty ..... 356/4.05
2006/0054186 A1* 3/2006 Lepage et al. ..... 134/6

FOREIGN PATENT DOCUMENTS

EP 214841 A2 * 3/1987

* cited by examiner

*Primary Examiner* — Michael Kornakov
*Assistant Examiner* — Eric Golightly
(74) *Attorney, Agent, or Firm* — Buskop Law Group, PC; Wendy Buskop

(57) ABSTRACT

A method for in-situ cleaning and inspecting of a tubular, comprising: deploying a closable housing to a tubular, hydraulically opening the closable housing and then hydraulically closing the closable housing around the tubular. Marine growth is removed from the tubular using a marine growth plough and high pressure water from at least one high pressure water jet unit, disposed a cleaning end of the closable housing. The cleaned tubular is inspected using at least one enclosable camera block containing at least one digital camera disposed on an inspection end of the closable housing. Signals from the cameras are communicated to a remote location. Hydraulic fluid and high pressure water are provided from the remote location to the closable housing. A tether is used to roll the closable housing along the tubular for continuous in-situ cleaning and inspection of the tubular without interrupting use of the tubular.

12 Claims, 7 Drawing Sheets

METHOD FOR IN-SITU CLEANING AND INSPECTING OF A TUBULAR

FIELD

The present embodiments relate to a method for in-situ cleaning and inspecting of a tubular.

BACKGROUND

A need exists for a method for in-situ cleaning and inspecting of tubulars that is capable of cleaning, inspecting, and measuring tubulars, while the tubulars are in use, without interrupting use of the tubulars.

A further need exists for a method for in-situ cleaning and inspecting of tubulars that utilizes continuous digital imaging to enable tubulars to be cleaned and inspected continuously, on a real-time basis.

A need has existed for a method, other than a visual inspection, to monitor the condition of a fiber or wire rope mooring line while in-service.

The present embodiments meet these needs.

BRIEF DESCRIPTION OF THE DRAWINGS

The detailed description will be better understood in conjunction with the accompanying drawings as follows.

Figure 1:
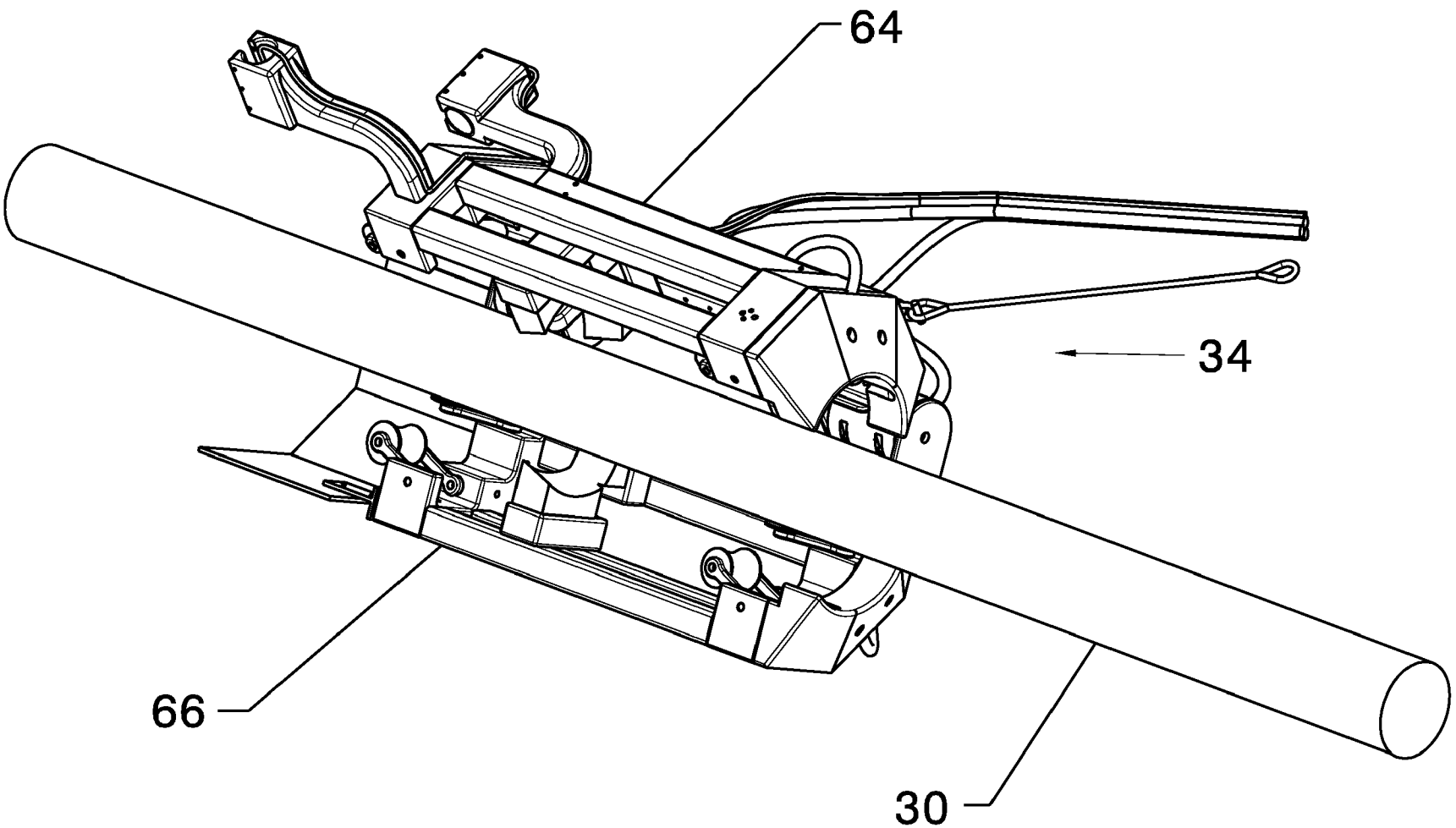
FIG. 1 shows the housing of the present tubular measurement system in an open position during deployment to a rope.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

Fiber and wire rope are the principle components of mooring systems on deep water installations. Conventional methods for inspecting the condition of these ropes require operators to periodically remove sacrificial and replace them with new rope. Analysis of removed sections determines the localized condition of the rope but does not provide an accurate picture of the overall condition of the mooring line. The present method invention was provides an accurate, "real time" picture of a mooring line, while the mooring line is in operation, without the need for a human or remotely operated vehicle (ROV), to actually inspect the line.

Conventionally, there are no existing methods, other than visual inspection, to continuously monitor the condition of a tubular, such as a fiber or wire rope mooring line, during use.

The present method is capable of in-situ cleaning and inspecting of a wide variety of tubulars, including wire robes, cables, fiber optic lengths, casings, risers, control umbilicals, and similar tubulars, while the measured tubulars are in use, and without interrupting use of the tubulars. This is a significant benefit over conventional inspection techniques, which can interfere with the operation of a tubular while removing and replacing sacrificial sections of the tubular.

Additionally, conventional visual inspection is limited in its accuracy, providing only a subjective determination of the condition of a small area of a tubular. The present method provides an image of the overall condition of an entire tubular, while the tubular is in use, by moving a closeable housing with digital cameras along a tubular and identifying changes in the tubular's cross-sectional geometry. The present method is capable of simultaneous cleaning of a tubular perimeter, while recording geometrical dimensions of the tubular for comparison with manufacturer specifications.

The present method saves human lives, by removing the need for humans to visually inspect ropes or moorings in deep water. The present method can be performed remotely, from a safe location, while providing a more comprehensive, more accurate measurement of the condition of a tubular.

Conventional methods enable only periodic assessment of a rope or tubular through analysis of removed portions. The present method can provide continuous cleaning, monitoring, and inspection of tubulars, enabling one or multiple tubulars to be monitored remotely. Multiple tubulars can be monitored simultaneously, enabling the present method to be useable within any number of facilities at one time.

There has existed a need for a method that can be deployed by an ROV to identify changes in the cross sectional geometry of a rope or other type of tubular. Changes in these measurements can indicate potential deterioration of the rope, which indicates a failure in a mooring system, which would cause a moored subsea structure to drift.

The present method includes deploying a closable housing to a tubular.

The closable housing or frame, herein termed the "RMS frame," is able to be moved along a section of in-situ fiber or wire rope, cleaning the surface and recording geometrical dimensions for comparison with manufacturer's specifications.

The method includes hydraulically opening the closeable housing, then hydraulically closing the closable housing around the tubular. At least two sets of roller assemblies engage the tubular when the closable housing is closed around the tubular.

The RMS frame is contemplated to have a first housing portion hinged to a second housing portion, and is maintained in an open position during deployment to the rope or cable or other tubular.

In an embodiment, the hinges can include one or more hydraulically operable hinge couplings, which can be actuated by one or more hydraulic actuators. One or more of the hydraulic actuators can include a preventer.

It is contemplated that the hinge coupling has a channel for receiving a removable hinge rod, such as a pin, for locking the hinges in a closed position.

FIG. 1 depicts the RMS frame or "closable housing" in the open position. Namely, the rope 30, which could be a tubular such as a casing, is shown. The rope 30 has a tubular perimeter 31. The RMS frame, or closable housing 34, is depicted in the open position, with the first housing portion 64 and the second housing portion 66 connected together in a hinged arrangement using hydraulic actuators. One of the two hydraulic actuators 22 is depicted herein.

An ROV can be used to deploy the RMS frame, to the fiber, wire rope, fiber optic length, casing, pipe, control umbilical, riser, or other tubular.

The housing can have a length ranging from about 2 feet to about 10 feet, a width ranging from about 1 foot to about 5 feet. The closeable housing is contemplated to have a central opening for accommodating a tubular having an outer diameter ranging from about ⅓ of a foot to about 6 feet.

Each portion of the housing is can be made from aluminum, stainless steel, carbon steel, an acetal copolymer, such as DELRIN™, or other similar durable materials. The first and second housing portions are contemplated to have substantially similar dimensions, however in an embodiment; one housing portion can have larger or smaller dimensions than the other housing portion.

The housing can have a coating, such as paint or powder for resisting corrosion, physical wear, and/or damage caused by exposure to inclement weather and marine environments.

In an embodiment, each housing portion can include one or more struts disposed between the cleaning end and the inspection end. The struts can be made from an acetal copolymer or another similar material.

As the closable housing is closed around the rope, cable or other tubular, it is contemplated that the tubular is centralized in the closable housing at least 4 roller assemblies and up to 8 roller assemblies. Each roller assembly can be disposed 45 degrees from another roller assembly around the tubular, enabling the closable housing to roll against the tubular while maintaining a secure contact with each roller assembly.

A first set of roller assemblies can be disposed on a cleaning end of the closable housing for engaging the tubular perimeter.

A second set of roller assemblies can be disposed on an inspection end opposite the cleaning end for engaging the tubular perimeter.

Each roller assembly can include a roller, which can be made from acetal copolymer or a similar material, for rolling along a roller shaft, which can be made from stainless steel.

The roller shaft is contemplated to engage a left control arm and a right control arm. Each control arm engages a suspension shaft which is secured to the closable housing.

The present method can then include removing marine growth from the tubular using a marine growth plough disposed on the cleaning end of the closable housing, and high pressure water from one or more high pressure water jet units on the cleaning end, forming a cleaned tubular.

The high pressure water jet units are contemplated to have one or more nozzles positioned to impact the tubular perimeter, for cleaning the tubular. Each high pressure water jet unit can include from one nozzle to four nozzles.

The marine growth plough can be made from an acetal copolymer or another similar material. The marine growth plough is contemplated to work in conjunction with the high pressure water jet units by physically engaging the tubular perimeter to remove marine growth from a tubular.

In an embodiment, a plurality of integrated brushes can also be used to clean the tubular after applying high pressure water, prior to inspecting the tubular.

The marine growth plough, one or more of the high pressure water jet units, one or more brushes, or combinations thereof are contemplated to be removable from the closable housing for providing customized types of cleaning to a tubular.

The present method then includes inspecting the cleaned tubular using at least one enclosable camera block containing one or more digital cameras and an imaging target plate. The enclosable camera blocks are disposed on the inspection end of the closable housing, opposite the cleaning end. It is contemplated that the digital cameras enable continuous digital imaging of the tubular as the closable housing rolls along the tubular.

The enclosable camera blocks can be made from an acetal copolymer or another similar material and are contemplated to be watertight and weather resistant to protect the enclosed cameras.

In an embodiment, it is contemplated that at least four enclosable camera blocks can be used, such that each enclosable camera block is positioned 90 degrees relative to one another and 90 degrees relative to the longitudinal axis of the tubular. This arrangement of cameras enables 90 degree cross-sectional images of the tubular to be captured simultaneously.

In an embodiment, the enclosable camera blocks can use video cameras, which record two cross sectional measurements of the tubular at 90 degrees to each other simultaneously.

The present method can also include using a removable camera arm disposed between the closable housing and the enclosable camera block to extend the distance between the enclosable camera block and the tubular. The removable camera arm is contemplated to be useful when cleaning and inspecting a large diameter tubular that requires more distance between the cameras and the tubular for inspection of the tubular.

The removable camera arm can be made from an acetal copolymer, aluminum, or another similar durable material.

The imaging target plate is contemplated to be disposed opposite the enclosable camera blocks for enabling continuous digital imaging of the tubular as the closable housing engages and rolls along the tubular.

In an embodiment, the present method can include using one or more integrated LED lights in each enclosable camera block for illuminating the tubular adjacent each camera against the imaging target plate.

The present method includes communicating signals from the digital cameras to a remote location, such as through use of a communication conduit. Remote locations can include any location, such as a top-side computer suite, located within or proximate to a facility moored using one or more tubulars that are inspected using the present method. Remote locations can also be in communication with one or more networks, allowing the present method to be performed at any number of facilities from any location worldwide.

In an embodiment, a signal from one or more video cameras can be transmitted via a ROV to a top side computer suite. The top side computer suite can include a processor having computer instructions for instructing the processor to process the signal at 50 frames per second, in real time, while simultaneously applying a mathematical model for continuous measurement of the tubular, creating a geometric tubular profile.

A digital recording system can be in communication with the processor for receiving and storing results of the real time computer image analysis and digital images from the digital cameras.

Computer instructions can be used to instruct the processor to compare the geometric tubular profile to a database of manufacturer's geometric tubular profiles in data storage associate with the processor, for determining real time deviations in the geometric tubular profile, which could indicate a failure of a mooring system.

The present method can include providing an indicator, such as an alarm, flashing light, other audio or visual signal, a report, or combinations thereof, indicating when a deviation occurs between the geometric tubular profile and the database of manufacturer's geometric tubular profiles. The indicator can be provided when the deviation exceeds a preset limit.

For fiber rope, potential deterioration is indicated if the diameter measurements are smaller than manufacturer's specifications. If measurements are greater than the manufacturer's specifications, this indicates a flattening in the rope's circumference, which is another sign of internal structural deterioration. For wire rope, an increase in diameter may be an indication of corrosion of interior wire strands.

The present method also includes providing hydraulic fluid from the remote location to the closable housing for actuation of the closable housing. The hydraulic fluid can be provided using any type of hydraulic conduit.

The present method further includes providing high pressure water from the remote location to the high pressure water jet units disposed on the cleaning end, using one or more high pressure water conduits.

A tether, which can be made from stainless steel or another similar material, is used to provide a variable tension from the remote location to the closable housing, enabling the closable housing to connect to a tubular and roll along the tubular. Use of the tether to roll the closable housing along the tubular enables continuous in-situ cleaning and inspection of the tubular, without interrupting use of the tubular.

In an exemplary embodiment, the present method can be deployed using a work class ROV (remotely operated vehicle) with a 7 function manipulator. The components in this example are contemplated to be a high resolution video camera array having 4 cameras with integrated LED lighting to illuminate the tubular against the background which is connected to the system. The RMS frame is preferably made from an acteal based polymer.

The signals from the cameras link at the surface to a digital recording system, with a wireless backup being contemplated herein. A real time computer image analysis program is used with a processor at the surface to determine the images of the tubular, or wire rope, in real time, simultaneously with the cleaning and inspection.

Turning now to the Figures, FIG. 1 depicts the RMS frame in an open position during deployment to a tubular 30, shown as a rope in this embodiment. The RMS Frame is also termed the closable housing 34 and has a first housing portion 64, and a second housing portion 66.

Figure 2:
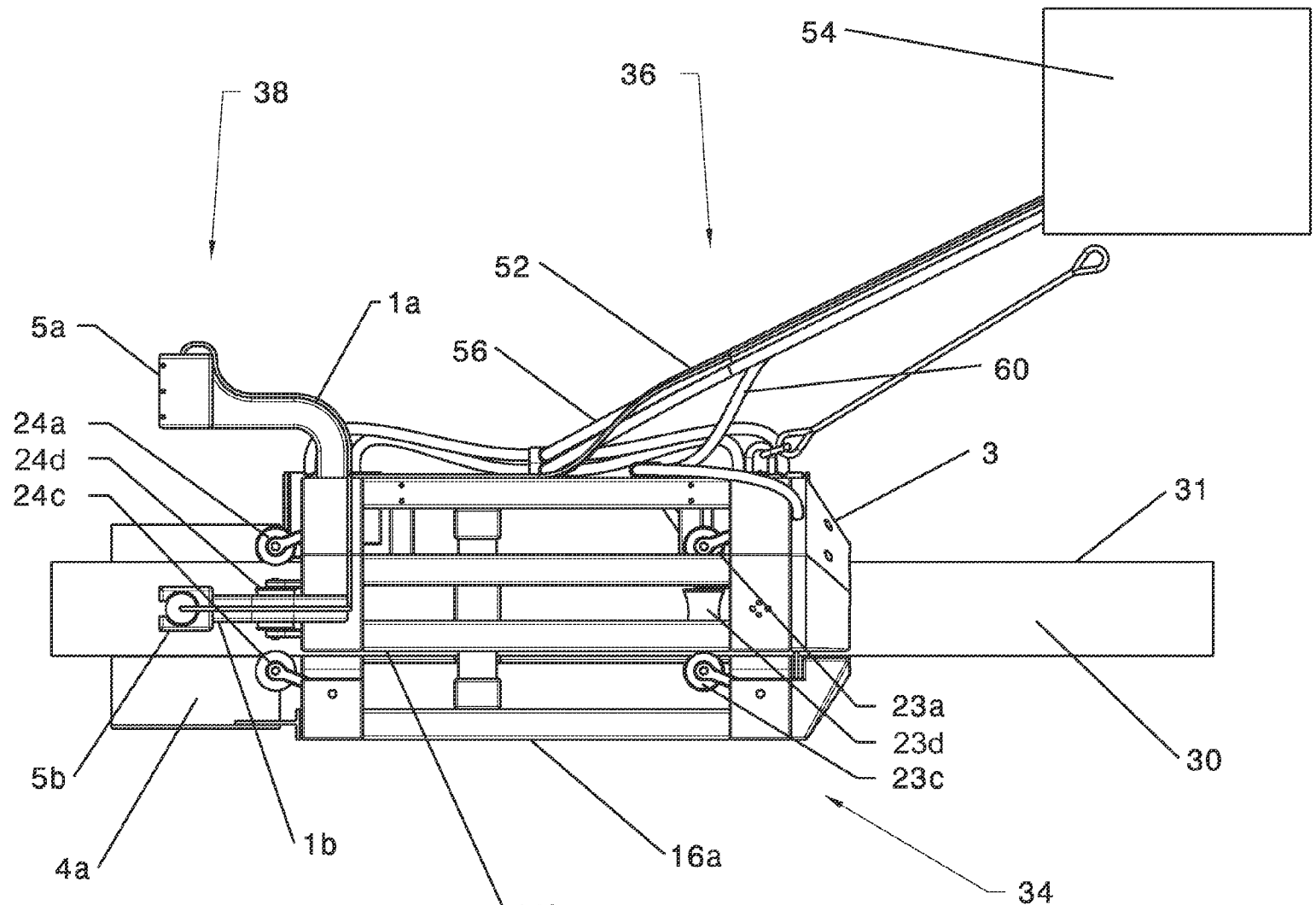
FIG. 2 is a side view of the closable housing of the present system.

FIG. 2 shows a side view of the closable housing 34 removably locked down over the tubular 30. The closable housing 34 is shown having a plurality of struts 16*a*, 16*b* disposed between a cleaning end and an inspection end of the closable housing 34. The cleaning end has a marine growth plough 3.

The depicted system has four enclosable camera blocks, although only two are visible in FIG. 2, as elements 5*a* and 5*b*. Each of the enclosable camera blocks 5*a*, 5*b* is connected to a camera arm 1*a*, 1*b*, which are secured to the housing portions at 90 degrees relative to one another around the tubular perimeter 31 of the tubular 30.

The camera blocks 5*a*, 5*b*, with the camera arms 1*a*, 1*b*, form the inspection end 38 of the closable housing 34. Opposite each enclosable camera block 5*a*, 5*b*, on the opposite side of the tubular 30 is an imaging target plate 4*a*. There is contemplated to be one imaging plate per enclosable camera block, although only one imaging target plate 4*a* is visible in FIG. 2.

A plurality of roller assemblies is disposed around the tubular 30 on the inspection end 38 and on the cleaning end 36. Around the cleaning end 36 of the closable housing 34 is a first set of roller assemblies 23*a-d*, and around the inspection end 38 is a second set of roller assemblies 24*a-d*. The first set of roller assemblies 23*b* is not shown in FIG. 2 but can be best seen in FIG. 6. The second set of roller assemblies 24*b* is not shown in FIG. 2 but can be best seen in FIG. 7. In this embodiment, the 4 roller assemblies per end are contemplated to be equidistantly disposed around the tubular perimeter 31.

A communication conduit 52 containing wire or fiber optics for conveying a signal to and from a remote location 54 to the cameras, and other electronics, is shown on the closable housing 34.

A hydraulic conduit 56 communicates from the remote location 54, which is contemplated to have a hydraulic source for providing hydraulic fluid to at least one hydraulic actuator of the present system.

A high pressure water conduit 60 conveys high pressure water 62 from the remote location 54 to at least one high pressure water jet unit having at least one nozzle oriented at the tubular 30 at the cleaning end 36. The high pressure water 62 is not shown in FIG. 2 but can be best seen in FIG. 5.

Figure 3:
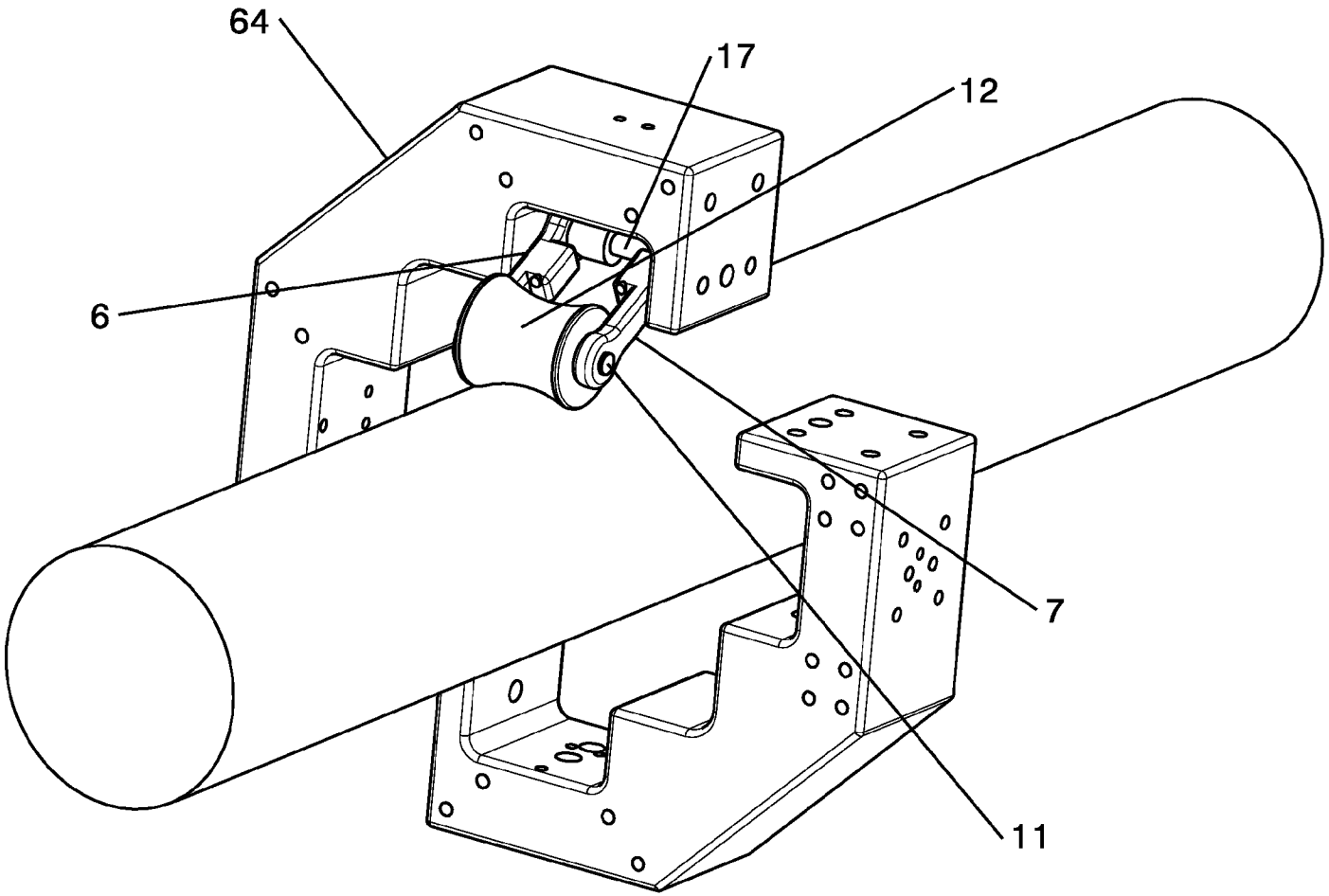
FIG. 3 shows a detailed view of one of the roller assemblies used to roll the closable housing.

FIG. 3 shows a detailed view of one of the roller assemblies used to roll the closable housing with the rope or other tubular. In this FIG. 3, the roller 12 is shown disposed around a roller shaft 11. The roller shaft 11 is supported on a left control arm 6 and a right control arm 7. The control arms 6, 7 are connected on a suspension shaft 17. The suspension shaft engages the first housing portion 64.

Figure 4:
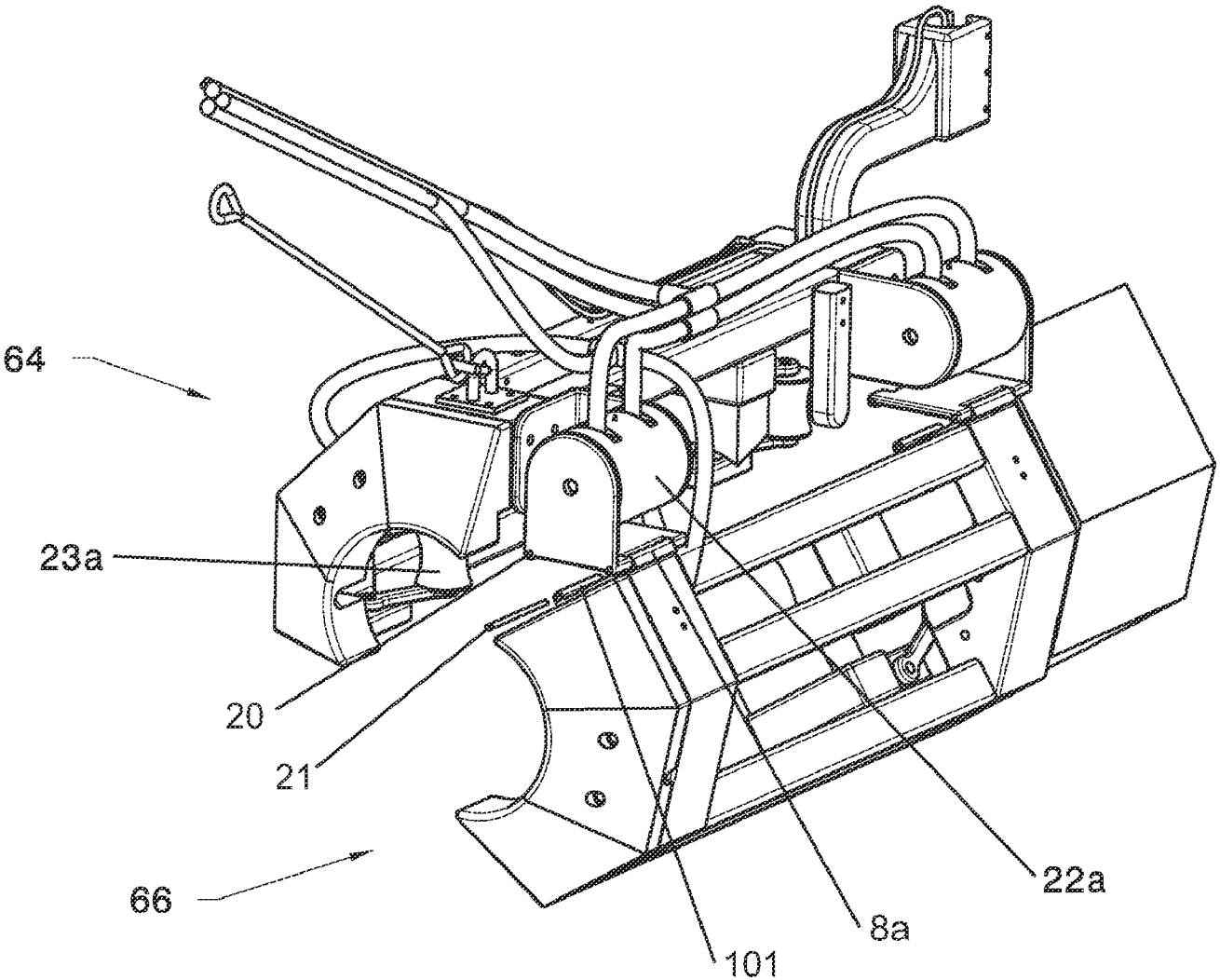
FIG. 4 shows the closable housing in an open or unhinged position.

FIG. 4 shows the closable housing in an open or unhinged position. FIG. 4 depicts a hydraulic actuator 22*a* connected to the first housing portion 64, which is connected by a hinge 8*a* to the second housing portion 66. Around the inner diameter of the housing portions can be seen the rollers of the first set of roller assemblies 23*a-d*.

In FIG. 4, it can be seen that a channel 20 is drilled in a portion of the hydraulic actuator 22*a*, and an extension 101 is disposed opposite the channel 20 to form a hinge locking mechanism, through which a removable hinge rod 21, such as a pin, can be disposed to lock the hydraulic actuator 22*a* closed around the tubular.

Figure 5:
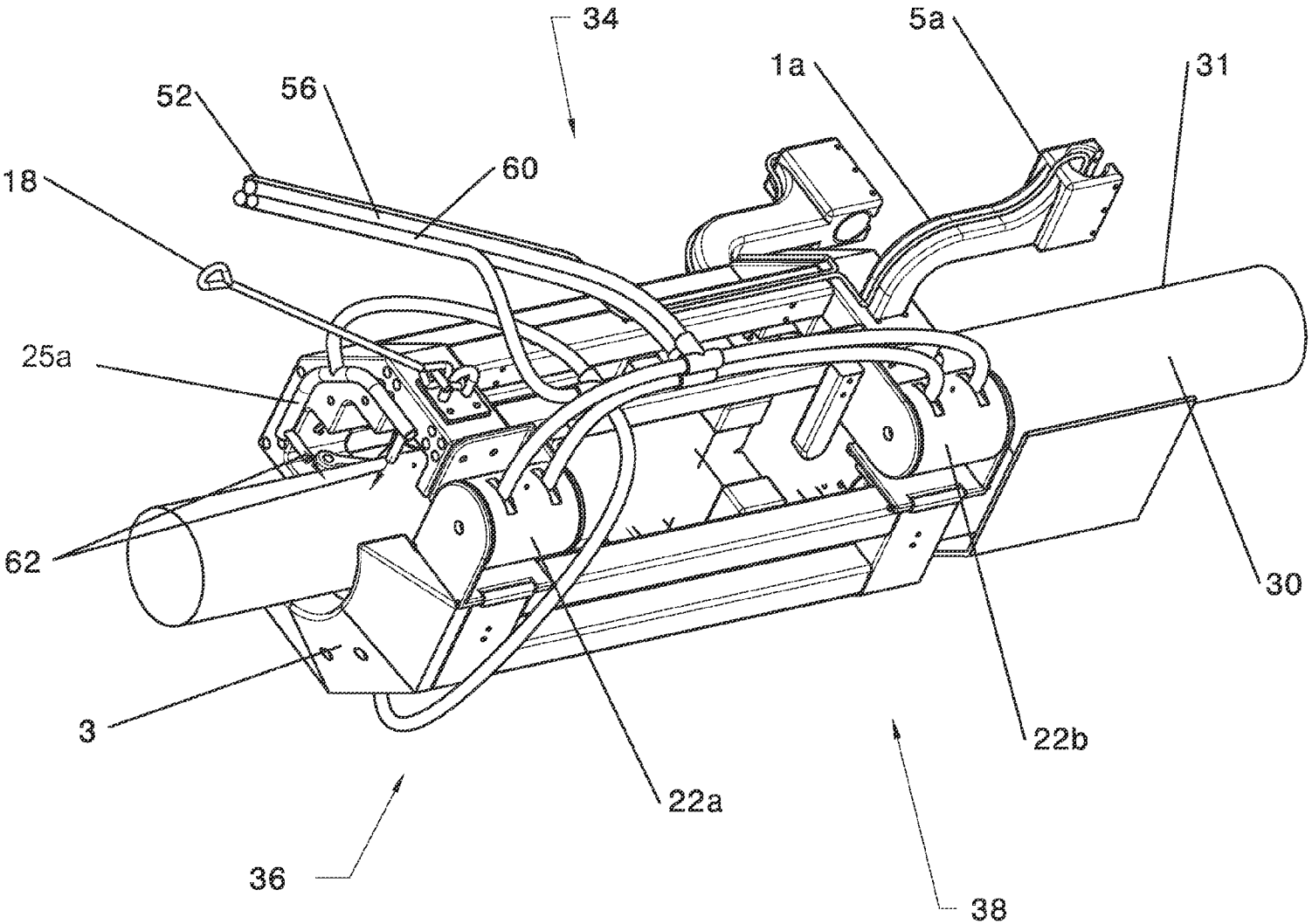
FIG. 5 shows the closable housing locked around the perimeter of a tubular.

FIG. 5 shows the closable housing 34 locked around the perimeter 31 of a tubular 30, which FIG. 5 depicts as casing for subsea drilling rigs. The closable housing 34 is depicted having the cleaning end 36 and the inspection end 38. The first hydraulic actuator 22*a* and the second hydraulic actuator 22*b* are also depicted.

A tether 18 for pulling of the closable housing 34 by an ROV is shown. The tether 18 is connected to an eye secured to the closable housing 34 with an eyepad. The hydraulic conduit 56, the high pressure water conduit 60, and the communication conduit 52 are shown bundled together. One of the enclosable camera blocks 5*a* is shown engaged to an arched camera arm 1*a*, which is secured to the closable housing 34.

The marine growth plough 3 is shown along with a high pressure water jet unit 25*a* with two nozzles that are secured to two different water pressure lines for cleaning marine growth from the tubular. FIG. 5 also depicts high pressure water 62 exiting the high pressure water jet unit 25*a*.

Figure 6:
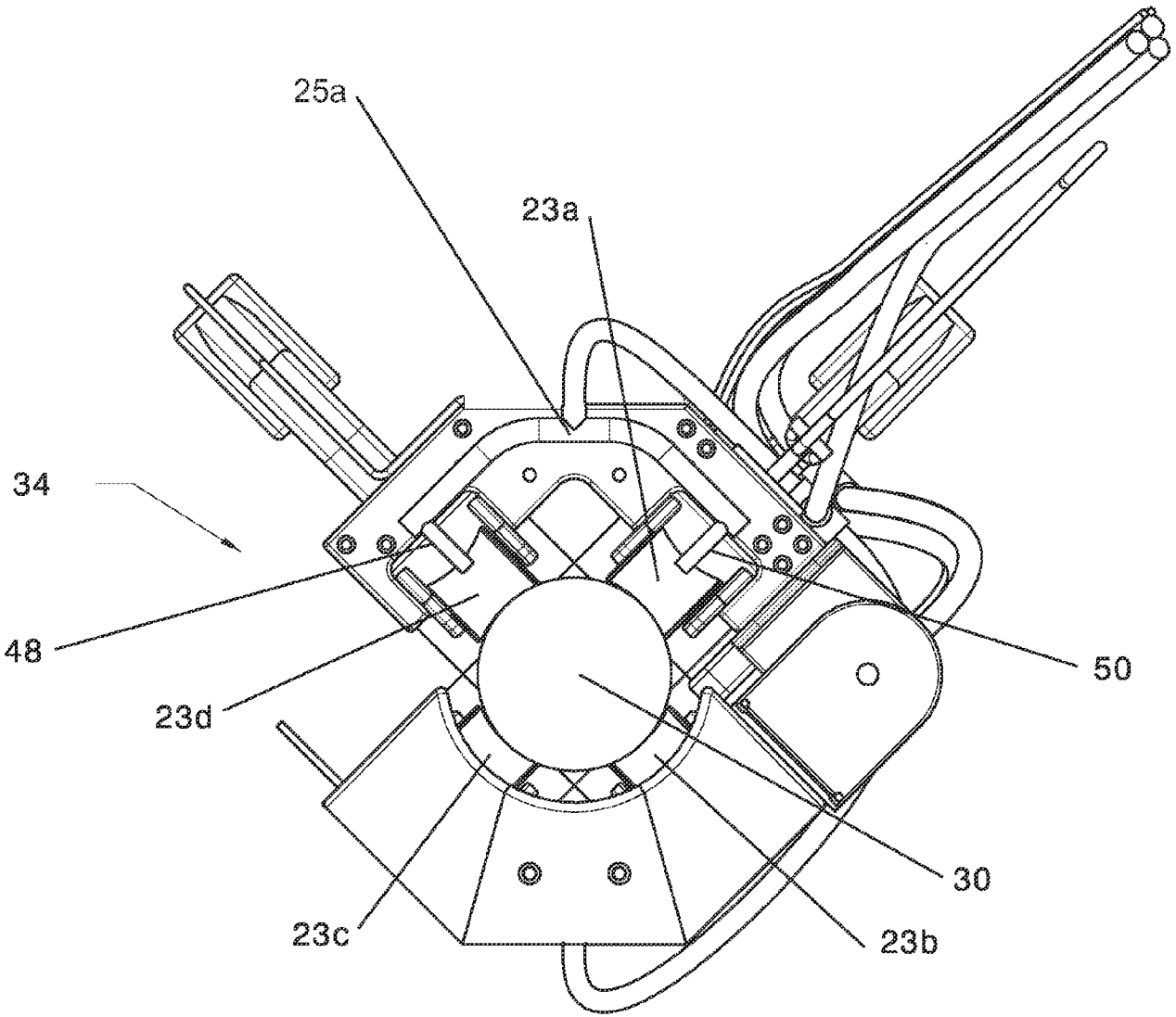
FIG. 6 depicts a detail of the closable housing with a first nozzle and a second nozzle for a high pressure water jet unit.

FIG. 6 depicts a detail of the closable housing 34 with a first nozzle 48 and a second nozzle 50 for a high pressure water jet unit 25*a*. The tubular 30 is shown, in this embodiment, enclosed in the closable housing 34. The first set of roller assemblies 23*a-d* are also depicted in this view.

Figure 7:
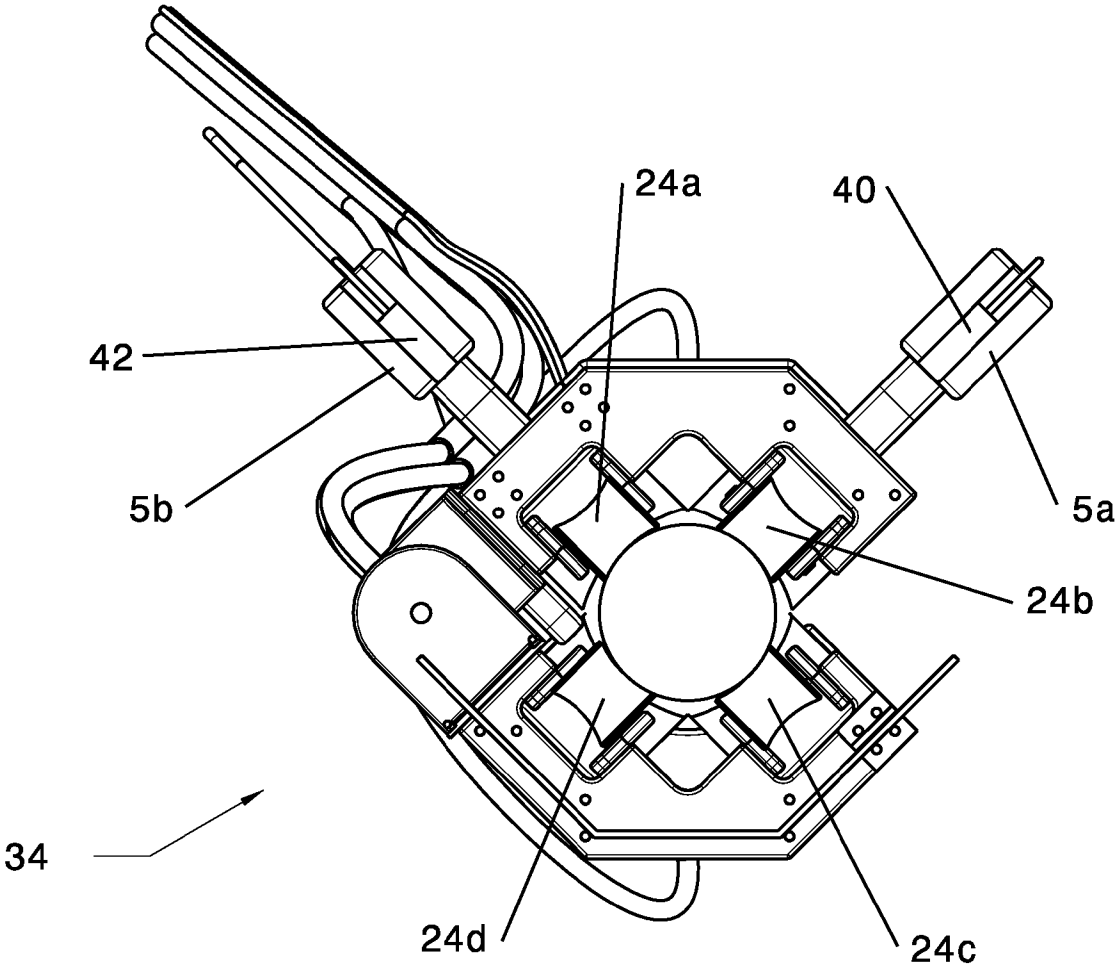
FIG. 7 shows a top view of an enclosable camera block with a first digital camera and a second digital camera enclosed therein.

FIG. 7 is a top view of an closable housing 34, which depicts a first enclosable camera block 5*a* with a first digital camera 40 and a second digital camera 42 enclosed in a second enclosable camera block 5*b*. The camera blocks are openable and closable, and are contemplated to form a strong watertight seal, for preventing water from affecting the digital video cameras. The second set of roller assemblies 24*a-d* is also depicted in this view.

While these embodiments have been described with emphasis on the embodiments, it should be understood that within the scope of the appended claims, the embodiments might be practiced other than as specifically described herein.

What is claimed is:

1. A method for in-situ cleaning and inspecting of a tubular, the method comprising the steps of:

deploying a closable housing to the tubular;

hydraulically opening the closable housing and then hydraulically closing the closable housing around the tubular, wherein at least two sets of roller assemblies engage the tubular;

removing marine growth from the tubular using a marine growth plough disposed on a cleaning end of the closable housing and water from at least one water jet unit on the cleaning end forming a cleaned tubular;

inspecting the cleaned tubular using at least one enclosable camera block containing at least one digital camera and an imaging target plate disposed on an inspection end of the closable housing opposite the cleaning end for continuous digital imaging of the tubular as the closable housing engages and rolls along the tubular;

communicating signals from the at least one digital camera to a remote location;

providing hydraulic fluid from the remote location to the closable housing;

providing water from the remote location to the at least one water jet unit;

using a tether to roll the closable housing along the tubular for continuous in-situ cleaning and inspection of the tubular without interrupting use of the tubular; and transmitting a signal from the at least one enclosable camera block using a video camera via a ROV to a top side computer suite, wherein the top side computer suite comprises a processor with computer instructions for instructing the processor to process the signal at 50 frames per second in real time while simultaneously applying a mathematical model for continuous measurement of the tubular creating a geometric tubular profile.

2. The method of claim 1, further comprising the step of replacing at least one digital camera in the enclosable camera block.

3. The method of claim 1, further comprising the step of using a removable camera arm between the closable housing and the enclosable camera block to extend the distance between the enclosable camera block and the tubular.

4. The method of claim 1, wherein the step of inspecting the cleaned tubular comprises using four enclosable camera blocks, wherein each enclosable camera block is positioned at 90 degrees to each other and 90 degrees to the longitudinal axis of the tubular.

5. The method of claim 4, wherein each enclosable camera block uses a video camera and the video cameras record two cross sectional measurements at 90 degrees to each other simultaneously.

6. The method of claim 1, wherein the step of hydraulically opening the closable housing and then hydraulically closing the closable housing around the tubular comprises using a hydraulically operable hinge coupling for hydraulically opening and closing the closable housing.

7. The method of claim 1, further comprising using computer instructions for instructing the processor to compare the geometric tubular profile to a database of manufacturer's geometric tubular profiles in data storage associated with the processor to determine real time deviations in the geometric tubular profile.

8. The method of claim 7, further comprising providing an indicator when a deviation occurs between the geometric tubular profile and the database of manufacturer's geometric tubular profiles.

9. The method of claim 1, wherein the tubular is a wire rope, a cable, a fiber optic length, a casing, a riser, or a control umbilical.

10. The method of claim 1, wherein the at least two sets of roller assemblies centralize the tubular in the closable housing, wherein the closable housing comprises at least four individual roller assemblies and up to eight individual rollers assemblies, and wherein each individual roller assembly is disposed between 45 degrees to 90 degrees from another roller assembly around the tubular enabling the closable housing to roll against the tubular while maintaining a secure contact with each roller assembly.

11. The method of claim 1, further comprising using an integrated LED light in each enclosable camera block to illuminate the tubular adjacent each camera against an imaging target plate.

12. The method of claim 1, further the step of using a plurality of integrated brushes to clean the tubular after applying the water prior to inspecting the tubular with the digital camera.

* * * * *